US008585316B2

(12) United States Patent
Taylor

(10) Patent No.: US 8,585,316 B2
(45) Date of Patent: Nov. 19, 2013

(54) STORM GRATE LOCKING DEVICE

(75) Inventor: Jerry D. Taylor, Cincinnati, OH (US)

(73) Assignee: Matt-Locks-USA LLC, Cincinnati, OH (US)

( * ) Notice: Subject to any disclaimer, the term of this patent is extended or adjusted under 35 U.S.C. 154(b) by 0 days.

(21) Appl. No.: 13/278,869

(22) Filed: Oct. 21, 2011

(65) Prior Publication Data

US 2013/0101347 A1 Apr. 25, 2013

(51) Int. Cl.
*E02D 29/14* (2006.01)
*B65D 55/14* (2006.01)
*E05C 19/00* (2006.01)

(52) U.S. Cl.
USPC ..... 404/25; 70/164; 292/301

(58) Field of Classification Search
USPC ..... 404/25, 26; 52/19–21; 49/50, 57, 463, 49/465; 70/160–173; 292/327, 301, 307 R, 292/319, 320, 326
See application file for complete search history.

(56) References Cited

U.S. PATENT DOCUMENTS

| | | | | | |
|---|---|---|---|---|---|
| 1,606,509 | A | | 11/1926 | Campbell | |
| 2,114,499 | A | * | 4/1938 | Maclear | 49/465 |
| 2,582,816 | A | | 1/1952 | Bonnell | |
| 3,390,224 | A | | 6/1968 | Wyatt | |
| 3,563,406 | A | * | 2/1971 | Ferrante | 220/248 |
| 3,921,494 | A | * | 11/1975 | Coe | 411/344 |
| 3,945,746 | A | | 3/1976 | Bredbenner | |
| 4,142,329 | A | | 3/1979 | Williams | |
| 4,257,193 | A | * | 3/1981 | Williams | 49/465 |
| 4,281,944 | A | * | 8/1981 | Bowman | 404/26 |
| 4,523,407 | A | * | 6/1985 | Miller | 49/465 |
| 4,871,451 | A | | 10/1989 | Piskula | |
| 4,961,387 | A | * | 10/1990 | Kneebone et al. | 105/377.07 |
| 5,056,955 | A | | 10/1991 | Spiess et al. | |
| 5,071,177 | A | | 12/1991 | Spiess et al. | |
| 5,324,135 | A | * | 6/1994 | Smith | 404/25 |
| 5,611,640 | A | * | 3/1997 | Bowman | 404/4 |
| 5,738,396 | A | * | 4/1998 | Oestermeyer et al. | 292/256.5 |
| 5,788,406 | A | * | 8/1998 | Hernandez | 404/25 |
| 6,092,244 | A | | 7/2000 | Rizzardi et al. | |
| 6,802,962 | B1 | | 10/2004 | Browne, III et al. | |
| 6,942,419 | B2 | | 9/2005 | Knak et al. | |
| 7,201,533 | B2 | | 4/2007 | DeGreef | |
| 8,347,670 | B2 | * | 1/2013 | Rix | 70/168 |
| 2006/0201213 | A1 | * | 9/2006 | Burke et al. | 70/168 |
| 2011/0005045 | A1 | | 1/2011 | Lill | |

* cited by examiner

*Primary Examiner* — Thomas B Will
*Assistant Examiner* — Abigail A Risic
(74) *Attorney, Agent, or Firm* — Hasse & Nesbitt LLC; Ronald J. Richter; Daniel F. Nesbitt

(57) ABSTRACT

A locking device for a storm grate to prevent theft or vandalism by unauthorized individuals. The device typically includes an upper plate, a positioning frame, at least one coupler nut, and a bolt. The positioning frame can include the coupler nut, a catch end for engaging the frame of the grate, a lower plate for engaging the underside of the grate, and a pliers handle for holding the device during insertion through a drain opening. In one embodiment, a second coupler nut is part of a wing wedge that secures a lower plate of the positioning frame to the underside of the grate. A method of inserting the device includes lowering the device through an opening in the grate, securing the catch end around the frame beneath the ground, and then tightening the bolt.

8 Claims, 7 Drawing Sheets

STORM GRATE LOCKING DEVICE

FIELD OF THE INVENTION

The present invention relates generally to storm grates or other water drainage or catch basin grates located near the curbs of paved roads, and more particularly to locking devices for such grates to prevent their theft.

BACKGROUND OF THE INVENTION

Storm grates, or water drainage grates, are commonly located along paved roadways to transport surface water into underground storm drains, or to house utilities. Such grates are commonly constructed out of cast iron, and typically include parallel spaced bars in a grid pattern, with the openings between the bars suited for receiving surface water. The upper surface of the grate is typically level with the road surface (i.e. the pavement).

Storm grates are usually mounted on an associated frame which is embedded in the ground or in concrete pavement near the curb. An interior ledge or supporting shoulder of the associated frame supports the weight of the grate, which fits flush with the frame aperture, such that the grate can be readily removed if it becomes necessary to clean out the storm drain, or for some other purpose. Although storm grates can be very heavy, weighing up to one-hundred fifty pounds, they are quite often removed from their mounting frames by unauthorized persons as an act of theft or vandalism. The large opening left behind in the pavement represents a serious injury hazard to a person or a vehicle, and the stolen grates must be replaced, with consequent expense to the city.

Although lockable grate systems are known, standard heavy storm grates which are lowered into their mounting frames and thereafter not locked or secured in any manner are still commonly used in many municipalities. Therefore, there is a need to secure storm grates in place to prevent unauthorized removal and the subsequent hazards resulting from a stolen or unseated grate.

The prior art discloses various ways of securing storm grates. U.S. Pat. No. 7,201,533 to DeGreef discloses a locking mechanism for preventing removal of the grate from its mounting frame by unauthorized persons. The locking mechanism includes a grate hold-down device which overlaps and completely encircles one of the grate bars, a threaded nut attached to the mounting frame below the hold-down device, and a bolt extending downwardly through the hold-down device into threaded engagement with the nut.

U.S. Pat. No. 6,942,419 to Knak discloses a system grate assembly which includes a frame and a complimentary grate which is designed to be locked to the frame by a specific locking device which is located below the grate, and is inaccessible from the street level.

U.S. Pat. No. 5,340,232 to Spiess discloses a manhole cover interlocked with a complimentary mounting frame. The cover and frame are designed to function together, and include a securing device which allows the grating or cover to be fitted and removed easily. The securing device is not locked to the frame, and comprises a "spring-clip" type device rather than a lock.

U.S. Pat. No. 4,142,329 to Williams discloses a locking assembly for a grate having two subassemblies that can be added to existing installed storm grates to prevent loss of the grate through theft or vandalism. The first subassembly is secured to the grate by a pair of cross plates and a bolt. The second subassembly supports a horizontal movable locking member and a compression coil spring which keeps the locking member engaged with the grate frame. A removable pivotal lever is used to move the locking member against the force of the coiled spring, thereby permitting the grate to be removed by authorized personnel.

While such prior art grate locking devices and systems may be useful for their intended purposes, there remains a need for a storm grate security lock that can be fitted easily onto existing unsecured storm grates to prevent their theft and protect them from vandalism. It would therefore be advantageous to provide a locking device for an unsecured storm grate that can be installed without having to remove the storm grate, which provides strong locking capacity, and which utilizes an uncomplicated design that is easy to manufacture.

SUMMARY OF THE INVENTION

The present invention provides a security locking device that can be easily installed on such unsecured grates so they may be locked to their mounting frames, for deterring would-be thieves or vandals from removing the grate.

A first aspect of the invention provides a locking device for securing an existing installed storm grate to its associated mounting frame, the locking device comprising: (a) an upper plate for placing on the top of the grate; (b) a positioning frame, the positioning frame comprising: (i) a pliers handle for holding the frame with a pair of pliers during insertion; (ii) a coupler nut; and (iii) a catch end for engaging the underside of the mounting frame of the grate; and (c) a bolt for passing through aligned holes in the upper plate and the coupler nut and securing the locking device onto the grate and its frame, wherein the locking device can be fitted onto an existing installed storm grate and its associated frame and locked in place without having to remove the storm grate.

A second aspect of the invention provides a locking device for securing an existing installed storm grate to its associated mounting frame without having to remove the storm grate, the locking device comprising: (a) a bolt for securing the locking device onto the grate and its frame; (b) an upper plate for receiving the bolt therethrough; (c) a positioning frame, the positioning frame comprising: (i) a lower plate for receiving the bolt therethrough; (ii) a pliers handle; (iii) a vertical arm; (iv) an elbow; (v) a horizontal arm including a first coupler nut for receiving the bolt therethrough; and (vi) a catch end adapted to engage the underside of the mounting frame; and (d) a wing wedge for engaging the underside of the grate, the wing wedge including a second coupler nut for receiving the bolt therethrough and a stop for blocking rotation of the wing wedge, wherein the wing wedge is screwed onto the bolt via the second coupler nut and positioned on the bolt beneath the lower plate and above the first coupler nut, and wherein during insertion of the device the wing wedge is rotatable about the bolt until rotation is blocked by the stop, the stop causing the wing wedge to take a final position substantially perpendicular to the positioning frame.

A third aspect of the invention provides a method of installing a locking device for securing an existing installed storm grate to its associated mounting frame without having to remove the storm grate, the method comprising: (a) holding a locking device with a pair of pliers; (b) lowering the locking device through a drain opening in the grate; (c) positioning a catch end of the locking device to engage an underside portion of the mounting frame; and (d) tightening a bolt of the locking device to secure the locking device to the grate and its associated mounting frame.

The positioning frame of the device can have a vertical arm, an elbow, and a horizontal arm leading to the catch end, or it can be in the shape of an elongated J-bolt which advances both vertically and horizontally towards its catch end. The catch end of the device is adapted to either engage or wrap around an underside of the mounting frame for the grate. The bolt head is typically specially configured in a manner known in the prior art, requiring a specially constructed wrench to unscrew the bolt for removing the lock, and thus for removing the grate from its frame. Unauthorized persons are typically unable to obtain the specially constructed wrenches, which are only available to authorized sewer maintenance personnel for sewer clean-out or repair purposes.

These and further objects, features, advantages and characteristics of the locking device of the present invention will be more fully appreciated upon viewing the following drawings, detailed description of the preferred embodiments, and claims.

BRIEF DESCRIPTION OF THE DRAWINGS

The accompanying drawings illustrate embodiments of the invention and, together with a general description of the invention given above, and the detailed description given below, serve to explain the principles of the invention.

DETAILED DESCRIPTION OF THE INVENTION

The present invention is a locking device for existing, unsecured removable sewer/storm grates that can be installed without having to remove the storm grate from its associated mounting frame.

Figure 1:
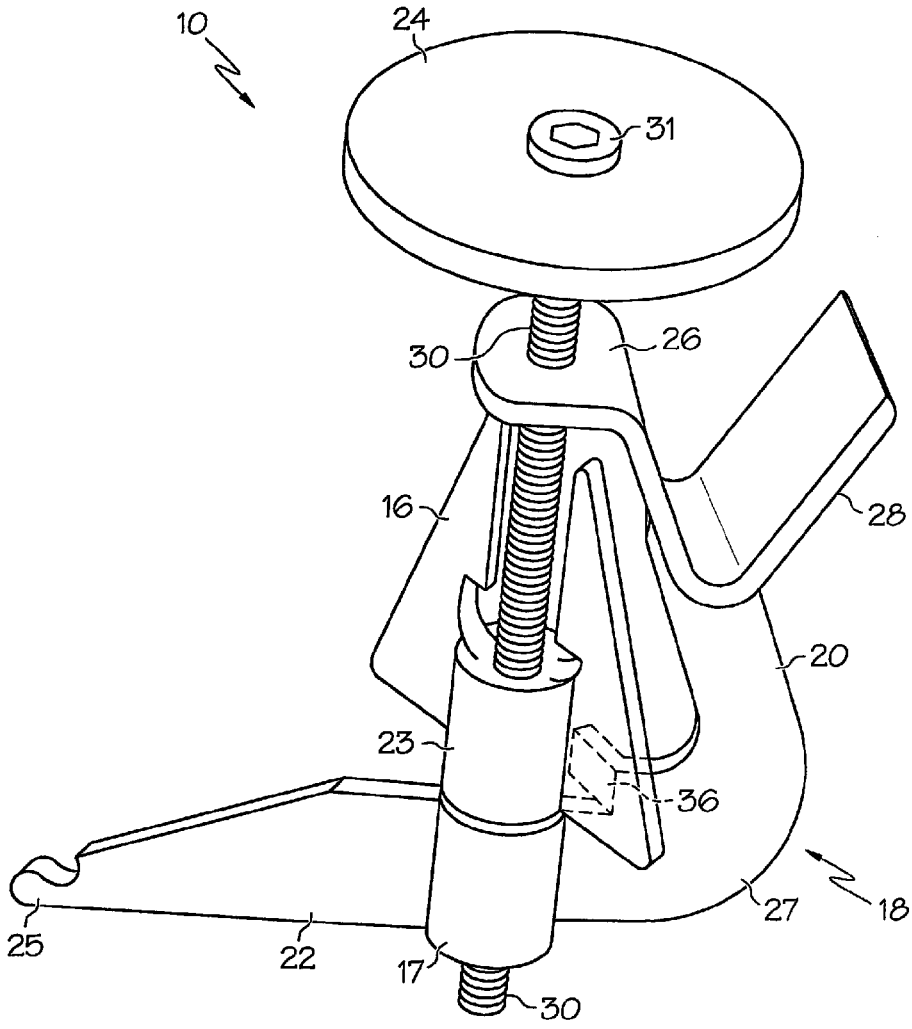
FIG. 1 is a perspective view of one embodiment of a locking device of the invention, having a wing wedge.

FIG. 1 illustrates one embodiment of the locking device of the present invention 10 (referred to as a "wing wedge" embodiment), which is adapted to lock a single storm grate to its associated mounting frame. The device 10 includes a positioning frame 18, an upper plate 24 and a bolt 30. The positioning frame 18 includes, at its proximal end, a lower plate 26 for receiving the bolt 30 therethrough, and pliers handle 28 for holding or gripping the device 10 during insertion. The frame 18 further includes a vertical arm 20, an elbow portion 27, a horizontal arm 22 with a first coupler nut 17 for receiving the bolt 30 therethrough, and a distal nose or "catch" end 25, for catching or engaging the underside of the drain's mounting frame or a ledge portion thereof. The elbow 27 portion of the positioning frame 18 provides a physical transition from the vertical arm 20 to the horizontal arm 22, so that the distal nose of the catch end 25 is able to engage any substantially horizontal underside of the grate's mounting frame. A wing wedge 16 also rotates about the bolt 30 and includes a second coupler nut 23 for receiving the bolt 30 therethrough.

Figure 2:
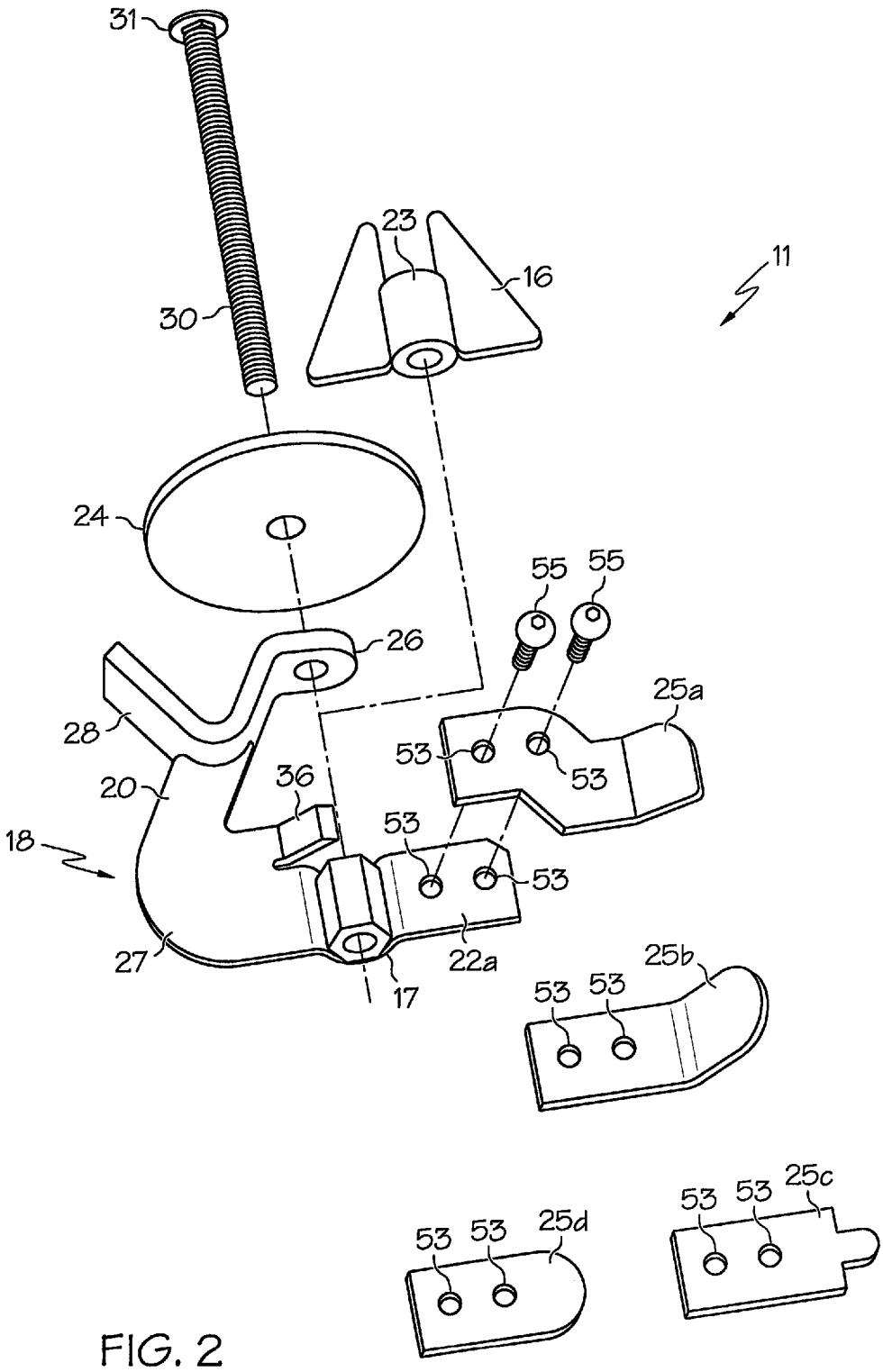
FIG. 2 is an exploded view of an embodiment similar to that of FIG. 1, but showing attachments for the catch end.

As illustrated in FIGS. 1 and 2, the bolt 30 passes through and screws into aligned holes in the following order: the upper plate 24, which serves as a washer for the bolt head 31 above the level of the grate, the lower plate 26, the coupler nut 23 of the wedge 16, and the coupler nut 17 of the positioning frame 18. The bolt 30 and coupler nuts 17, 23 are typically threaded and adapted so that the bolt screws down and into threaded engagement with the coupler nuts. The bolt 30 typically includes a bolt head 31 that requires a special wrench to screw/unscrew the bolt, as is known in the art.

FIG. 2 is an exploded view of another wing wedge embodiment 11 similar to the embodiment 10 of FIG. 1. However, in this embodiment 11 the positioning frame 18 includes a series of modified catch ends 25*a*, 25*b*, 25*c* and 25*d* for engaging the underside ledges of atypical or different types of mounting frames. The modified catch ends 25*a-d* are attachments for a modified horizontal arm 22*a*, which is substantially flat at its distal end but includes holes 53 for receiving attachment bolts 55. Attachment bolts 55 are used to reversibly connect the different attachments 25*a-d*, each of which also include pairs of holes 53 that can be aligned with those in the modified horizontal arm 22*a*.

Specifically, attachment 25*a* of FIG. 2 is intended for situations in which the depth of the underside ledge of the mounting frame is lower than a typical ledge. The downward turn of the attachment end can be specifically manufactured to fit the depth of a particular frame ledge. Attachment 25*b* is intended for use in situations in which the drain openings of the grate are not perpendicular to the frame (e.g. for diagonal drain openings). The slight bend of attachment 25*b* allows it to grip the underside of the frame, regardless of the angle of the drain openings to the frame. Attachment 25*c* is intended for use in situations where the walls of the mounting frame have no underside ledge, such that there is no place for the catch end of the positioning frame to engage the mounting frame. In such a situation, typically a ⅜" hole can be drilled into the mounting frame or pavement, the hole to be used as a gripping point for the attachment. The horizontal arm 22*a* can be fitted with a drill head tip for the purpose of creating the hole. Attachment 25*d* is intended for use in situations where the underside ledge of the mounting frame is not substantially right-angular for engaging from below, so that the curved catch end can engage and grasp some portion of the underside of the frame. Other attachments can be specifically manufactured to fit a specific type of mounting frame ledge.

Figure 3:
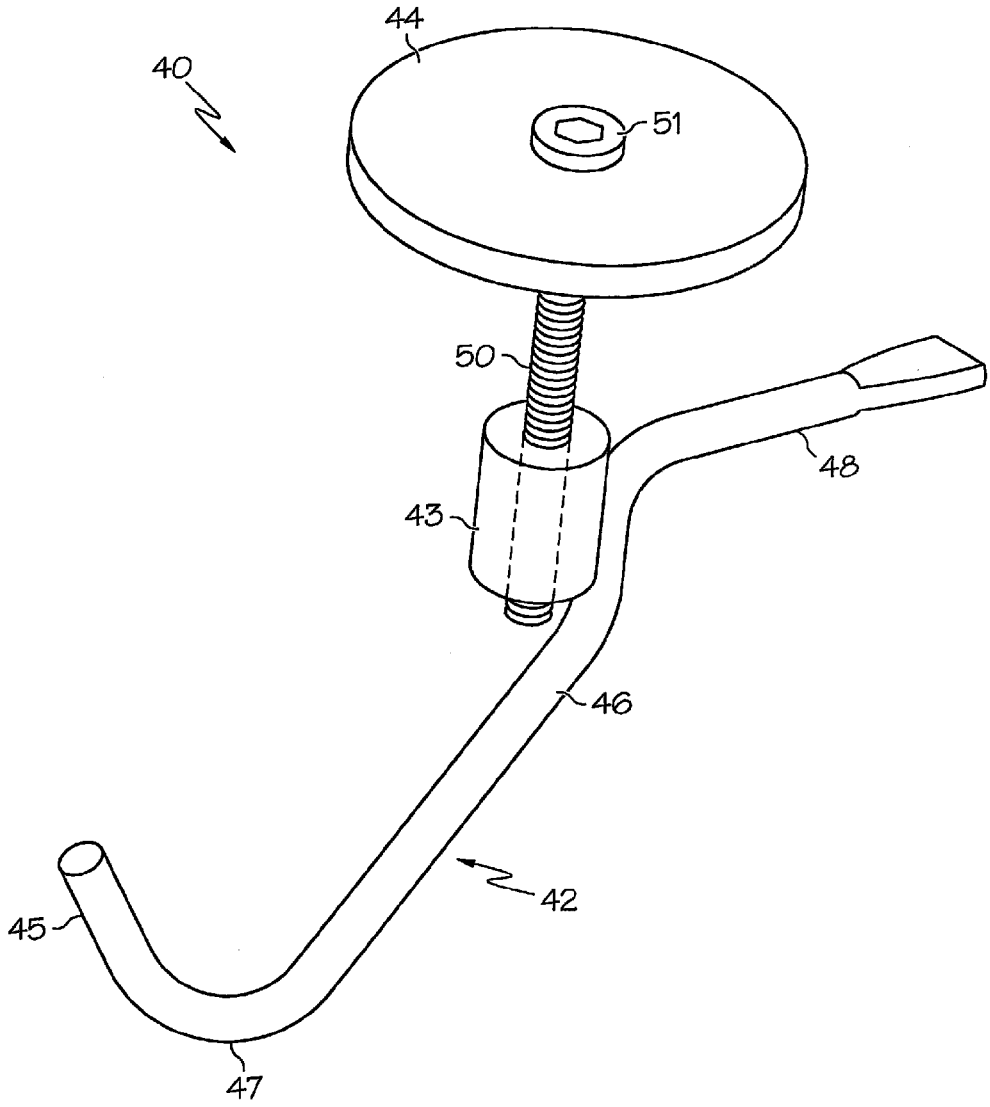
FIG. 3 is a perspective view of another embodiment of a locking device of the invention.

FIG. 3 illustrates another embodiment of the locking device of the invention 40 (referred to as the "J-hook" embodiment), and includes a positioning frame 42 substantially in the shape of an elongated letter "J". This embodiment also includes a coupler nut 43, an upper plate 44 and a bolt 50. The positioning frame 42 includes a catch end 45 for engaging and securing the device around a large I-beam or to the underside of a deeply embedded mounting frame (see FIG. 4), an elongated arm 46 that travels in both a vertical and a horizontal direction, an elbow 47 transitioning the elongated arm 46 to a catch end 45, and pliers handle 48 at the proximal end. As illustrated, the coupler nut 43 is typically welded to the positioning frame 42 at the juncture between pliers handle 48 and the top portion of the elongated arm 46. While the J-shaped positioning frame 42 is straight horizontal at this welding juncture, it can be appreciated by viewing FIG. 3 that the positioning frame 42 gradually begins to travel in both a vertical and horizontal direction before reaching the elbow 47. This is intended to allow the device to reach vertically below the level of the frame and also to engage its horizontal underside via the catch end 45.

Figure 4:
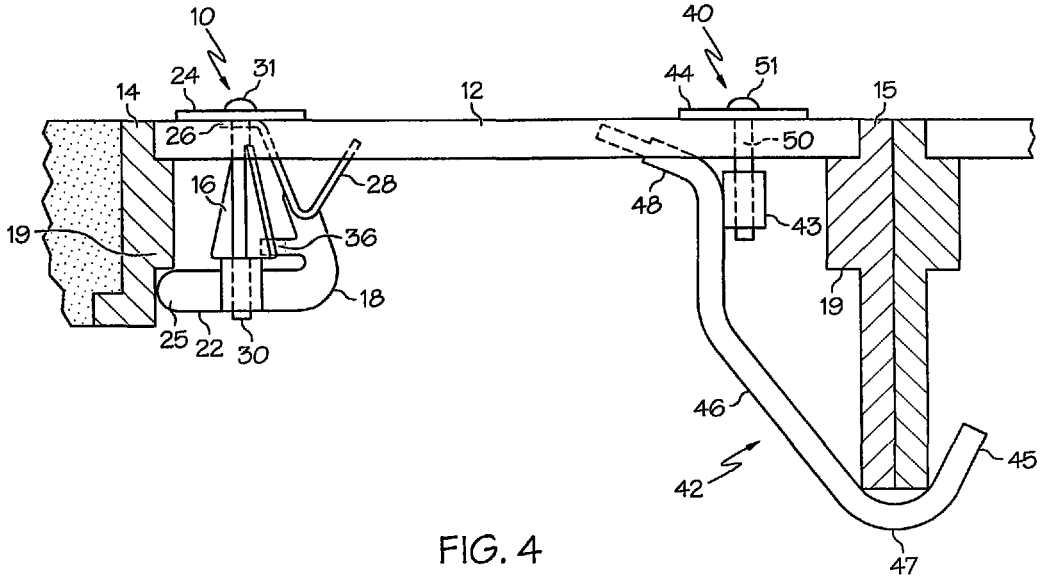
FIG. 4 is a partial perspective view of embodiments of the invention removably secured to a grate and its associated mounting frame.
Figure 5:
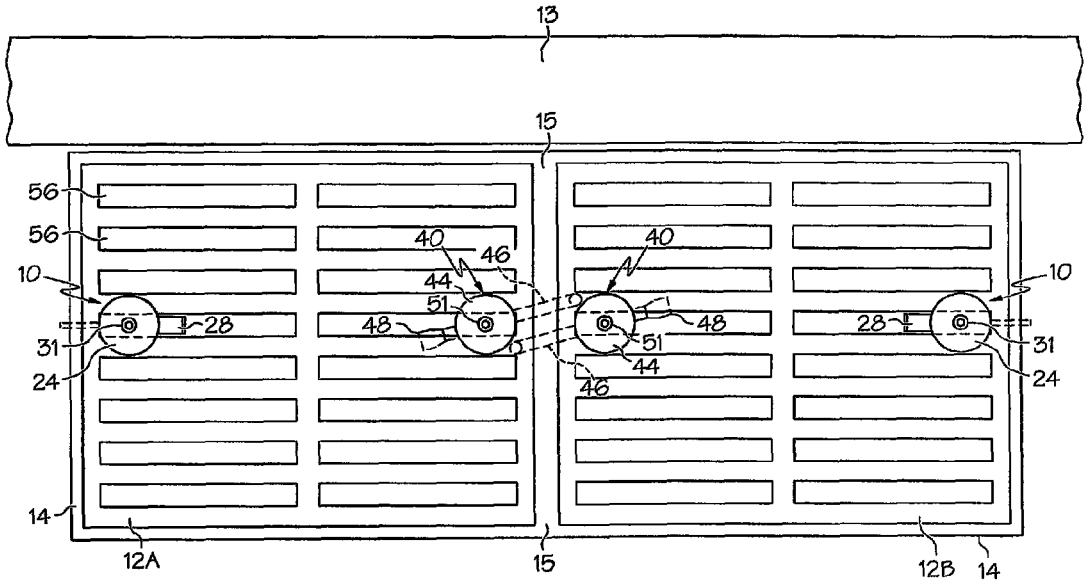
FIG. 5 is a top perspective view showing embodiments of the invention securing a double grate.
Figure 7:
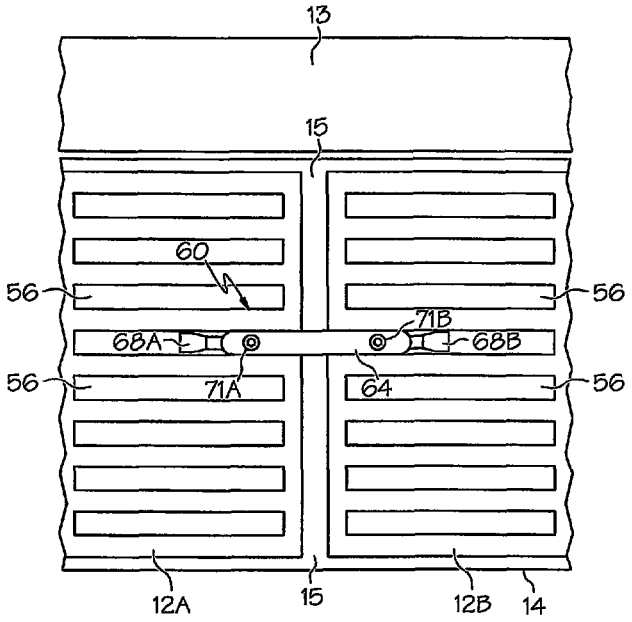
FIG. 7 is a top perspective view showing the embodiment of FIG. 6 securing a double grate.

As shown in FIG. 4, the locking devices illustrated in FIGS. 1, 2 and 3 can be removably secured to a standard storm grate 12 and its associated mounting frame 14 or I-beam 15. Typical storm grates are rectangular in shape and have a series of bars connected in a grid pattern and spaced to form drain/grate openings (see FIGS. 5 and 7). The grate can be a single grate, or two grates may be seated together side by side in a double grate configuration, as depicted in FIGS. 4, 5 and 7. The grate 12 is typically seated on an associated mounting frame 14 which is permanently integrated with the ground or pavement, and both are typically made of a heavy, one-piece cast iron construction.

The left half of FIG. 4 illustrates a "wing wedge" embodiment 10 (or 11) of the locking device of the invention secured to the left underside edge 19 of the grate 12. It can be appreciated that the positioning frame 18 is situated substantially beneath the level of the grate 12, with the catch end 25 of the horizontal arm 22 engaging the underside ledge 19 of the mounting frame 14, and the wing wedge 16 engaging the underside of the grate 12.

During placement of the wing wedge device 10, the wedge 16 is initially inserted parallel with the drain openings (56, see FIG. 5) so that it can fit through the storm grate 12 and into the space beneath the grate. As the bolt 30 is tightened, the wing wedge 16 rotates about the bolt 30 until the stop 36 blocks further rotation of the wedge 16. At this point further rotation of the wedge 16 is blocked by the stop 36 in a position substantially perpendicular to the positioning frame 18, as illustrated. The bolt is then further tightened and the wing wedge 16 is drawn upward towards the grate 12 and partially into the drain opening it was inserted through, until the slanted outside edges, or "wings" of the wing wedge 16 make contact with the underside of the grate 12. After fully tightening the bolt, the wing wedge 16 is lodged against the underside of the grate 12. The contact points of the wings of the wing wedge 16, along with the contact points provided by the catch end 25 to the ledge 19 and the upper plate 24 with the top of the grate 12 (all of which are secured by the bolt 30), serves to fix the device 10 in place and secure the grate 12 to the grate frame 14.

FIG. 4 also illustrates the "J-hook" embodiment 40 of the locking device inserted at the right underside edge of the grate 12. The positioning frame 42 is gripped by the user via pliers handle 48 and lowered through one of the drain openings to a position substantially beneath the level of the grate 12, with the catch end 45 passing completely underneath and around the mounting frame or I-beam 15 at the elbow 47. The positioning frame 42 is then secured in place by tightening the bolt 50 as it passes through the upper plate 44, which is placed on top of the grate 12, and the coupler nut 43 of the positioning frame 42, which is located below the grate 12. The upper plate 44 and the coupler nut 43 have aligned holes to receive the bolt 50. Contact points fix the device 40 in place and secure the grate 12 to the grate frame 14, and include the contact between the elbow 47 portion of the catch end 45 to the I-beam 15, and the upper plate 44 with the top of the grate 12. The bolt is typically tightened via a special wrench engaged in the bolt head 51, and the locking device 40 is secured to the grate 12 and frame 15 until an authorized individual uses the special wrench to loosen the bolt 50 and remove the locking device 40.

FIG. 5 shows a standard heavy storm grate system and its associated mounting frame, as viewed from above. This particular grate includes a double grate configuration, with two grates 12A, 12B mounted side by side next to a roadside curb 13, and a central I-beam portion 15 forming the center of the mounting frame 14 between the two grates. Here, both the "wing wedge" embodiment 10 (or 11) and "J-hook" embodiment 40 are used to secure each of the grates 12A, 12B. As illustrated, once the devices are inserted, only the upper plates 24, 44 and the bolt heads 31, 51 of the devices are exposed above the level of the grates 12A, 12B. The remaining portions of the devices are located either within a drain opening 56 or substantially beneath the level of the grates, after being inserted through one of the drain openings 56. It can also be appreciated by viewing this figure that these devices 10, 40 can be inserted without having to remove the grate from its associated frame.

Looking at the wing wedge embodiments 10 of FIG. 5, it can be appreciated that the pliers handle 28 can be gripped by the user to lower the device through one of the drain openings 56 to a position beneath the level of the grate 12. The device 10 is then secured in place by tightening the bolt head 31. The wing wedge 16 is initially lowered beneath the grate in a direction parallel to the openings 56, and then rotates about the bolt during tightening until it is stopped (by the stop 36) at a position substantially perpendicular to the drain openings. Once in this perpendicular position, further tightening of the bolt causes the slanted side walls of the wing wedge to make contact with the underside of the bars of the grate and so become lodged or otherwise secured to the underside of the grate 12.

While the double grates 12A and 12B illustrated in FIG. 5 show cross drain openings 56 that are perpendicular to one side and parallel to another side of the grates, a particular storm grate may have diagonal drain openings and still be securable by the locking device of the present invention. For example, as discussed and illustrated in FIG. 2 above, the "wing wedge" embodiment of the device 10 can include an attachment 25*b* at its catch end that curves to reach the ledge of the grate frame. Further, the "J-hook" embodiment 40 can be modified to include a swivel (see FIG. 6) which allows the positioning frame 46 to rotate about an axis and thus allow its catch end 45 to grip the underside of the frame, regardless of the angle of the drain openings to the frame.

As the name implies, the pliers handles 28, 48 are intended for holding the device with a pair of pliers as the positioning frame 18, 42 is lowered through one of the drain openings 56 of the grate. The catch end 25 of the "wing wedge" embodiment 10 of FIG. 1 (or one of the catch end attachments 25*b-d* of the embodiment 11 of FIG. 2) is then directed by the user to engage the ledge 19 of the mounting frame 14. Similarly, the catch end 45 of the "J-hook" embodiment 40 of FIG. 3 is directed by the user to hook around the mounting frame or I-beam 15 (see FIG. 4). Once the frame or I-beam of the grate is engaged by the elbow 47 of the catch end 45, then the bolt is tightened and the device is secured in place until removed by an authorized person. Placement of the majority of the device below the level of the grate assures that the only portion of the device exposed and thus accessible to the public above the level of the grate is the upper plate 24, 44 and the bolt head 31, 51 (See FIG. 5). Typically, only authorized personnel will have the correct wrench needed to access the bolt head and loosen the locking device.

Figure 6:
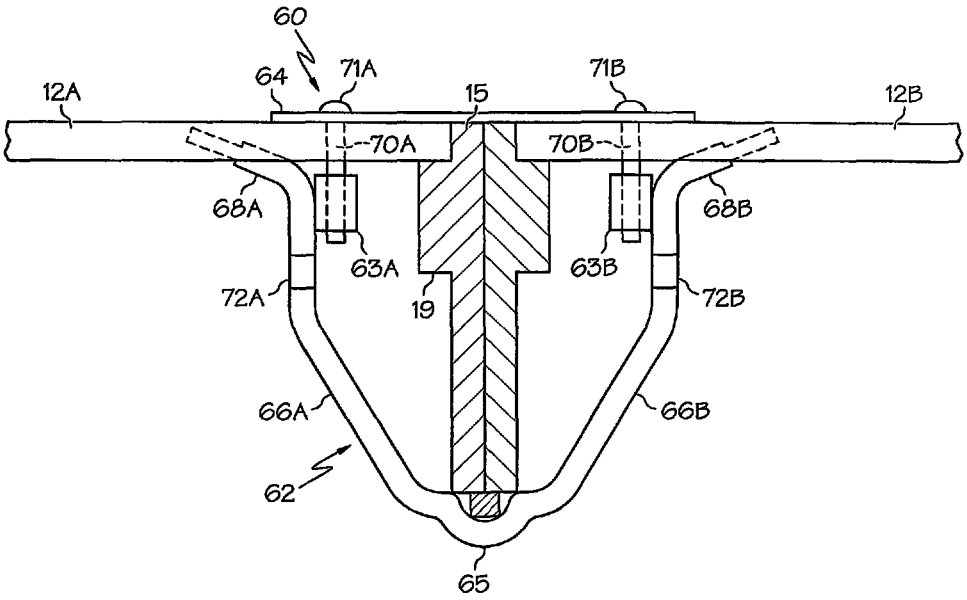
FIG. 6 is a perspective view of another embodiment of the locking device of the invention.

Another embodiment of the invention is illustrated in FIG. 6, which shows a locking device 60, referred to as the "U-hook" embodiment, including an elongated positioning frame 62 substantially in the shape of the letter "U". It can be appreciated that this U-hook embodiment 60 essentially incorporates two J-hooks (i.e. from FIGS. 2 and 4) in a single mechanical element, such that a double storm grate can more easily and quickly be secured. The U-hook device 60 includes two coupler nuts 63A, 63B, and an elongated upper plate 64 that stretches all the way across the top of the central I-beam 15 (see FIG. 7) and is secured by bolts 70A, 70B having heads 71A, 71B. The U-shaped positioning frame 62 includes a catch end 65 for engaging and securing the device around the large I-beam 19. While the catch end 65 is generally flat for securing around large I-beams, it can be manufactured to have a central portion in the shape of a teardrop, as illustrated. This tear-drop shape allows the catch end 65 to hook around both a wide portion (typically about four inches wide) of an I-beam 19, and also to envelope a narrow portion (typically about two inches wide) that are sometimes present, or to fit around oddly shaped I-beams. The two elongated arms 66A, 66B travel in both a vertical and a horizontal direction to join at the catch end 65. This embodiment has at least one pliers handle 68A for grasping the device with pliers during insertion through the drain openings as described above, but as illustrated here can also include a second pliers handle 68B for allowing the user to grasp either and/or both ends of the device during insertion.

The embodiment of FIG. 6 also illustrates a first swivel 72A and a second swivel 72B, each swivel 72A, 72B being located just below the first coupler nut 63A and the second coupler nut 63B, respectively. While each of the coupler nuts 63A, 63B are typically welded to the positioning frame 62 at the juncture between their respective pliers handles 68A, 68B and elongated arms 66A, 66B, the swivels 72A, 72B allow for rotation of the tips of the device (i.e. the pliers handles 68A and 68B) on an axis. This swiveling action is desirable for adjusting the device to fit at any angle necessary while fitting through the drain openings and/or securing the U-shaped catch end 65 around the I-beam 15. While FIG. 6 illustrates the swivel element for the U-hook embodiment 60, one of skill in the art will understand and appreciate that the swivel element can also be used on the J-hook embodiment of FIGS. 3 and 4, and will be useful in rotating the securing the catch end 45 of the J-hook around an I-beam that is at an angle to the direction of the drain openings. Typically each swivel 72 can be in the form of a simple coupler nut that can turn the pliers handles 68 about an axis, but other swivel designs as are known in the art can be employed.

To secure the U-hook device 60 of FIG. 6, the entire device can first be grasped at the first pliers handle 68A and inserted/lowered through a drain opening (56, see FIG. 7) on one side of the I-beam 15 (e.g. the left side), and the positioning frame 62 can then be maneuvered so that the second pliers handle 68B, the second coupler nut 63B, and the second elongated arm 66B are threaded under and around the I-beam 15. The distal end or, if included, the second pliers grip 68B, is then directed upwards towards the drain opening of the second grate 12B of the two grates, causing the catch end 65 to be seated directly beneath the I-beam, as illustrated. The swivels 72A, 72B can allow the tips of the device to then be rotated into a position that is optimal for securing the bolts 70A, 70B through their respective coupler nuts and the elongated upper plate 64, so that the device 60 is secured across the I-beam 15 and to the two grates 12A, 12B.

FIG. 7 shows a top perspective view of the device 60 of FIG. 6 secured a standard heavy storm grate having a double grate configuration and its associated mounting frame 14. The grate includes two grates 12A, 12B mounted side by side and a central I-beam portion 15 forming the center of the mounting frame 14 between the two grates. As illustrated, once inserted, only the elongated upper plate 64 and the bolt heads 71A, 71B of the devices are exposed above the level of the grates 12A, 12B. The remaining portions of the devices are located either within a drain opening, such as the tips 68A, 68B, or substantially beneath the level of the grates. In FIG. 7, it can be appreciated that the elongated upper plate 64 can be a long, flat stock washer that holds both ends at the same time, allowing the connection of the flat stock washer to the two bolts 70A, 70B.

The locking device of the invention is typically made of a high strength corrosion-resistant material such as metal, and can include a coating which further protects the metal against corrosion. Such coatings can be a powder coating (paint powder applied in an oven to form a continuous film over the metal) or a trivalent chromate coating. Trivalent chromates produce a harder, scratch-resistant coating with lower water content providing more heat resistance. The bolt is preferably made of stainless steel, and is between about 3 inches and about 7 inches long, more preferably about 5 inches long, and between about ⅜ inches to about ½ inches in diameter, for ensuring a strong locking engagement with the frame. The height of the wing wedge embodiments 10, 11 is between about 3 inches and about 7 inches long, more preferably about 5 inches long as this is the typical depth of the underside ledge of a mounting frame, and the height of the J-hook and U-hook embodiments is between about 7 inches and about 15 inches long, but can be made longer or shorter, depending on the depth of the mounting frame or I-beam that the device must engage below.

While the present invention has been illustrated by the description of embodiments and examples thereof, it is not intended to restrict or in any way limit the scope of the appended claims to such detail. Additional advantages and modifications will be readily apparent to those skilled in the art. Accordingly, departures may be made from such details without departing from the scope or spirit of the invention.

What is claimed is:

1. A locking device for securing an existing installed storm grate to its associated mounting frame, the locking device comprising:

c) an upper plate for placing on the top of the grate;

d) a positioning frame, the positioning frame comprising:

i) a pliers handle for holding the frame with a pair of pliers during insertion;

ii) a coupler nut; and iii) a catch end for engaging the underside of the mounting frame of the grate; and c) a bolt for passing through aligned holes in the upper plate and the coupler nut and securing the locking device onto the grate and its frame, the positioning frame further comprising a lower plate for receiving the bolt therethrough, a vertical arm, an elbow, and a horizontal arm leading to the catch end, the locking device further including a wing wedge for engaging the underside of the grate, the wing wedge including a second coupler nut for receiving the bolt therethrough and a stop for blocking rotation of the wing wedge, wherein the wing wedge is screwed onto the bolt via the second coupler nut and positioned on the bolt beneath the lower plate and above the first coupler nut, and wherein during insertion of the device the wing wedge is rotatable about the bolt until rotation is blocked by the stop, the stop causing the wing wedge to take a final position substantially perpendicular to the positioning frame, wherein the locking device can be fitted onto an existing installed storm grate and its associated frame and locked in place without having to remove the storm grate.

2. The locking device of claim 1, wherein the bolt includes a bolt head that requires a special wrench to turn the bolt.

3. The locking device of claim 1, wherein the positioning frame includes a modified horizontal arm adapted to receive a series of catch end attachments for engaging the mounting frame.

4. A locking device for securing an existing installed storm grate to its associated mounting frame without having to remove the storm grate, the locking device comprising:

a) a bolt for securing the locking device onto the grate and its frame;

b) an upper plate for receiving the bolt therethrough;

c) a positioning frame, the positioning frame comprising:

i) a lower plate for receiving the bolt therethrough;

ii) a pliers handle;

iii) a vertical arm;

iv) an elbow;

v) a horizontal arm including a first coupler nut for receiving the bolt therethrough; and vi) a catch end adapted to engage the underside of the mounting frame; and d) a wing wedge for engaging the underside of the grate, the wing wedge including a second coupler nut for receiving the bolt therethrough and a stop for blocking rotation of the wing wedge, wherein the wing wedge is screwed onto the bolt via the second coupler nut and positioned on the bolt beneath the lower plate and above the first coupler nut, and wherein during insertion of the device the wing wedge is rotatable about the bolt until rotation is blocked by the stop, the stop causing the wing wedge to take a final position substantially perpendicular to the positioning frame.

5. The locking device of claim 4, wherein the positioning frame includes a modified horizontal arm adapted to receive a series of catch end attachments for engaging the mounting frame.

6. The locking device of claim 4, wherein the bolt includes a bolt head that requires a special wrench to turn the bolt.

7. A method of installing a locking device for securing an existing installed storm grate to its associated mounting frame without having to remove the storm grate, the method comprising:

a) holding a locking device with a pair of pliers;

b) lowering the locking device through a drain opening in the grate;

c) positioning a catch end of the locking device to engage an underside portion of the mounting frame; and tightening a bolt of the locking device to secure the locking device to the grate and its associated mounting frame, the locking device further including a wing wedge for engaging the underside of the grate, the wing wedge including a second coupler nut for receiving the bolt therethrough and a stop for blocking rotation of the wing wedge, the positioning frame further including a lower plate for receiving the bolt therethrough, wherein in step (b) the wing wedge is lowered through the drain opening in a direction parallel to the opening, and in step (d) the wing wedge rotates about the bolt to a final position substantially perpendicular to the positioning frame.

8. The method of claim 7, wherein the locking device comprises the catch end, the bolt, an upper plate and a positioning frame, the positioning frame comprising a pliers handle at a proximal end for holding the device in step (a), and a coupler nut for receiving the bolt in step (d).

* * * * *